US007335137B2

(12) United States Patent
Wu

(10) Patent No.: US 7,335,137 B2
(45) Date of Patent: Feb. 26, 2008

(54) DRIVE SYSTEM FOR MAGNETIC RESISTANCE EXERCISERS

(76) Inventor: Chang Ming Wu, P.O. Box 44-2049, Taipei (TW) 10668

( * ) Notice: Subject to any disclaimer, the term of this patent is extended or adjusted under 35 U.S.C. 154(b) by 69 days.

(21) Appl. No.: 11/341,496

(22) Filed: Jan. 30, 2006

(65) Prior Publication Data

US 2007/0179026 A1 Aug. 2, 2007

(51) Int. Cl.
*A63B 22/06* (2006.01)

(52) U.S. Cl. ..... 482/57; 482/63; 474/84

(58) Field of Classification Search ..... 482/51, 482/57, 63–65, 114, 115, 120, 148, 903; 474/69, 474/70, 73, 76, 77, 84–87
See application file for complete search history.

(56) References Cited

U.S. PATENT DOCUMENTS 4,705,493 A * 11/1987 Lin ..... 474/69
4,822,032 A * 4/1989 Whitmore et al. ..... 482/63
4,955,599 A * 9/1990 Bersonnet et al. ..... 482/63
2003/0078140 A1 * 4/2003 Chang ..... 482/51

* cited by examiner

*Primary Examiner*—Jerome Donnelly
*Assistant Examiner*—Tam Nguyen

(57) ABSTRACT

A drive system for a magnetic resistance exerciser includes a fixed wheel and at least one rotatable wheel which are rotatably connected to the weight wheel and the fixed wheel by two respective belts. The fixed wheel and the weight wheel share a common shaft which is perpendicularly connected with a link and the at least one rotatable wheel is rotatably connected to an extension on an end of the link. When rotating the shaft, the link rotates and the at least one rotatable wheel rotates about the shaft and the extension simultaneously so that the rotational speed of the weight wheel can be increased without increasing the whole system.

2 Claims, 8 Drawing Sheets

DRIVE SYSTEM FOR MAGNETIC RESISTANCE EXERCISERS

BACKGROUND OF THE INVENTION (1) Field of the Invention

The present invention relates to a drive system for a magnetic resistance exerciser wherein the rotational speed of the weight wheel can be increased without increasing the whole system.

(2) Description of the Prior Arts

A conventional magnetic resistance exerciser generally includes a fly wheel and a weight wheel which is connected to the fly wheel by a belt. The user treads the pedals to speed up the fly wheel which drives the weight wheel so as to obtain different levels of resistance. If the ratio of speed of the fly wheel and the weight wheel is to be increased, the size of the fly wheel has to be increased and this occupies too much space and the manufacturing cost is increased accordingly.

The present invention intends to provide a drive system for increasing the rotational speed of the weight wheel while the fly wheel is remained the same.

SUMMARY OF THE INVENTION

The present invention relates to a driving system for a magnetic resistance exerciser and the system comprises a link having a shaft extending perpendicularly from a mediate portion thereof and two extensions perpendicularly extend from two ends of the link. The shaft is rotatably connected to a support member on which a fixed wheel is fixedly connected. A belt groove is defined in an outer periphery of the fixed wheel. At least one rotatable wheel has a through hole defined in a center thereof and a first groove is defined in an outer periphery of the at least one rotatable wheel. A first extension portion extends from a side of the at least one rotatable wheel and a second groove is defined in the first extension portion.

A weight wheel has a second extension portion extending from a side of the weight wheel and a third groove is defined in the second extension portion. The shaft rotatably extends through the weight wheel and the fixed wheel, and two cranks are connected to two ends of two ends of the shaft. One of the extensions of the link rotatably extends through the through hole of the at least one rotatable wheel. A first belt is engaged with the belt groove of the fixed wheel and the second groove of the first extension portion. A second belt is engaged with the first groove of the at least one rotatable wheel and the third groove of the second extension portion. When rotating the cranks, the link is rotated to move the at least one rotatable wheel about the shaft and the at least one rotatable wheel rotates about the extension of the link and drives the weight wheel by the belt so as to accelerate the weight wheel.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
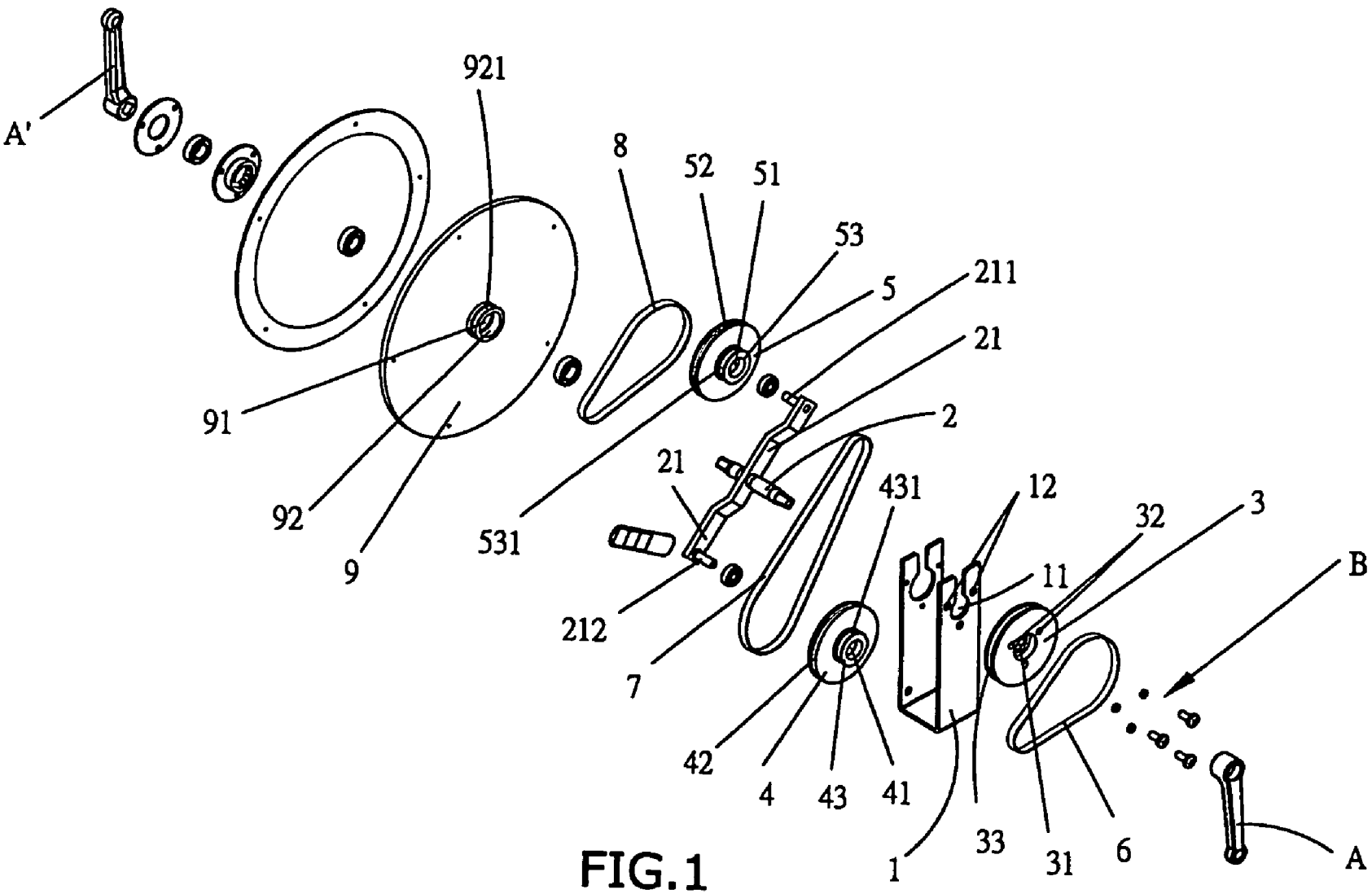
FIG. 1 is an exploded view to show the drive system of the present invention.
Figure 2:
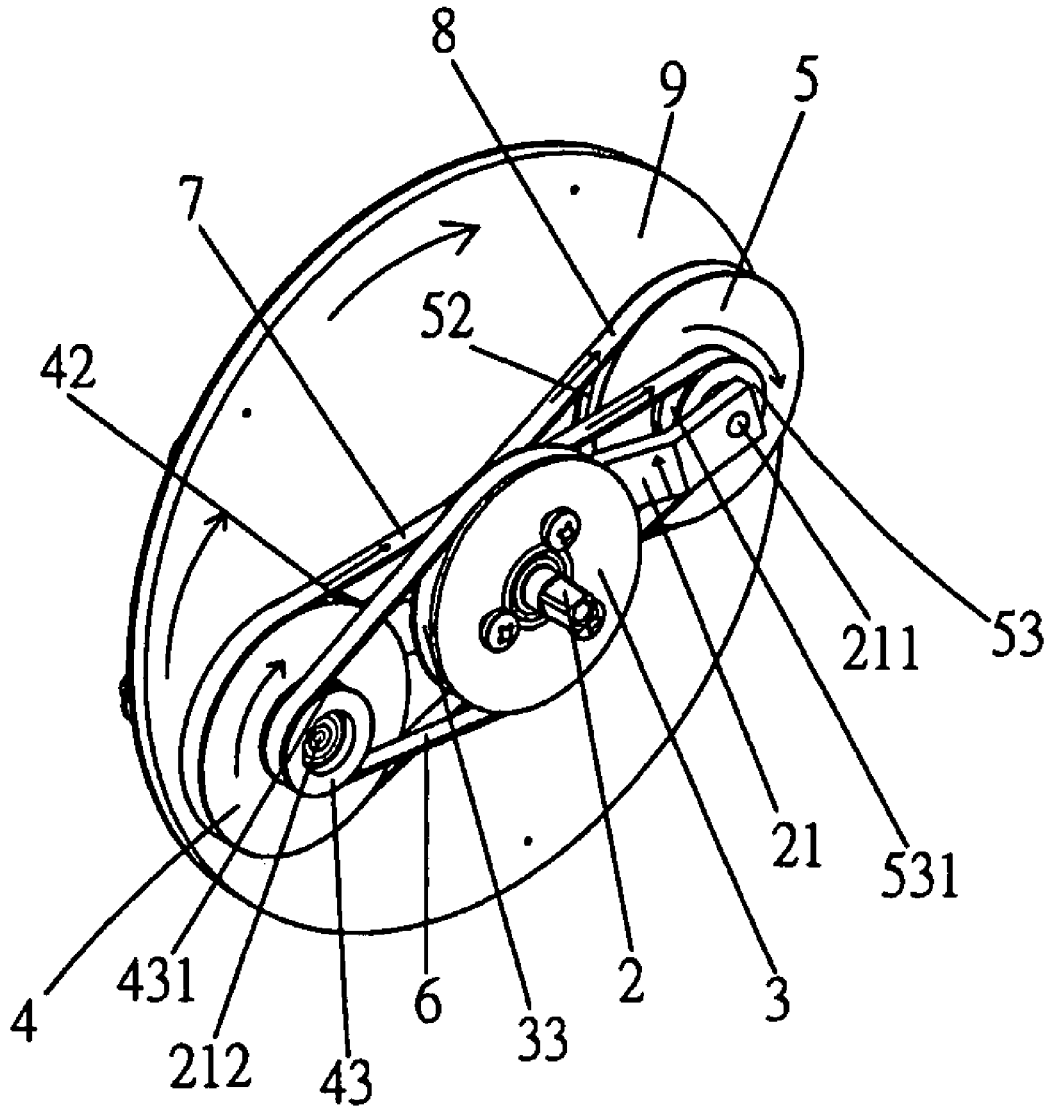
FIG. 2 is a perspective view to show the connection of the fixed wheel, the rotatable wheels, and the weight wheel of the drive system of the present invention.
Figure 3:
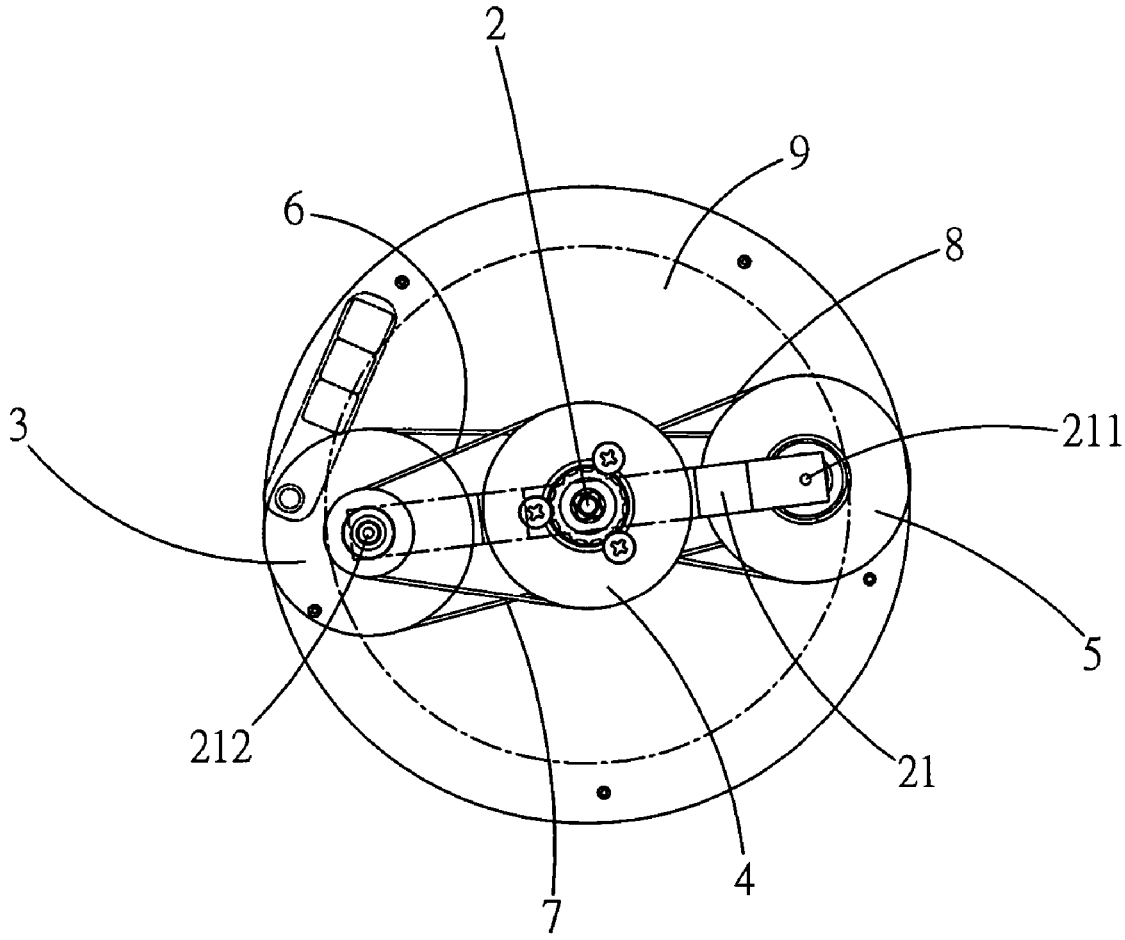
FIG. 3 is a side view to show the drive system of the present invention.
Figure 4:
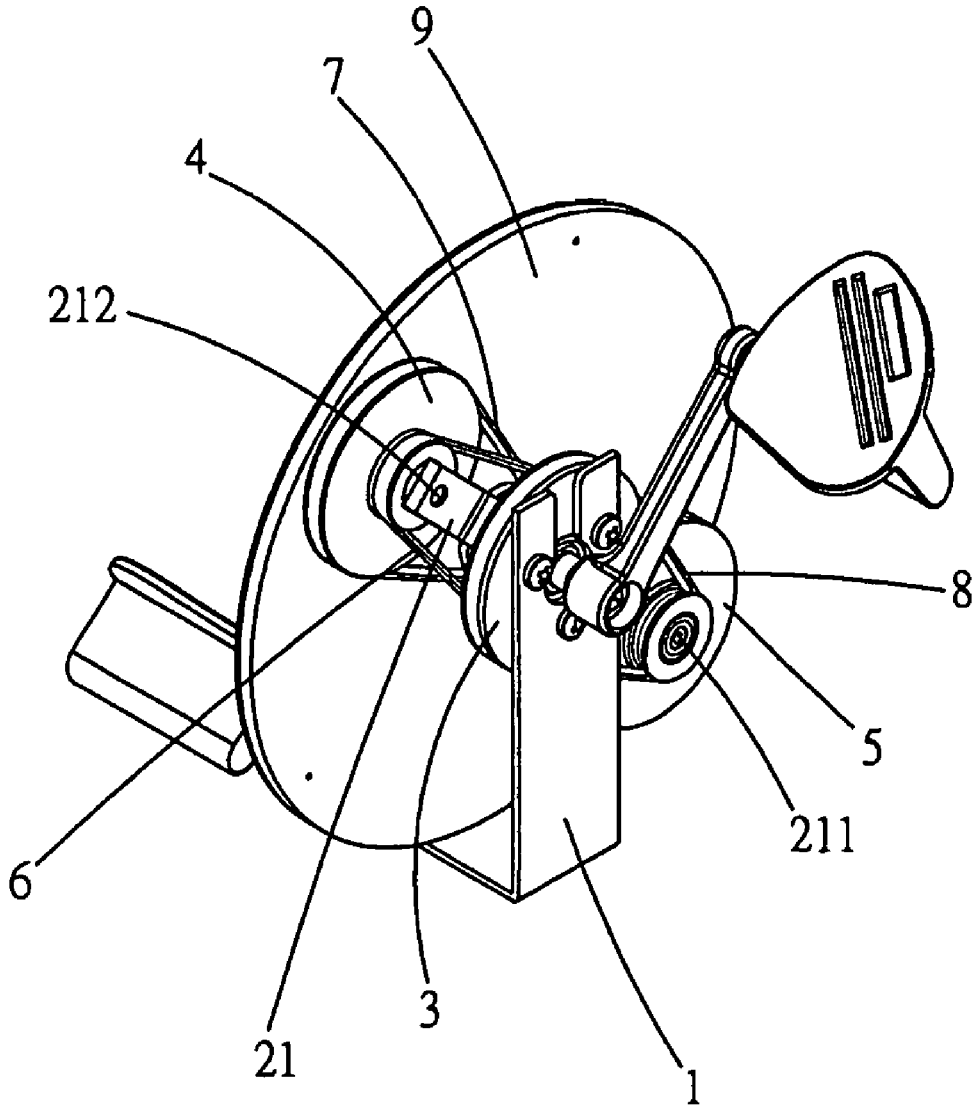
FIG. 4 is a perspective view to show the drive system of the present invention.

Referring to FIGS. 1 to 4, the driving system for a magnetic resistance exerciser of the present invention comprises a U-shaped support member 1 having a through hole 11 defined therethrough and a plurality of positioning holes 12 defined beside the through hole 11. A link 21 has a shaft 2 extending perpendicularly from a mediate portion thereof and two extensions 211, 212 perpendicularly extend from two ends of the link 21.

A fixed wheel 3 is fixedly connected to the support member 1 by bolts "B" extending through the positioning holes 32 in the fixed wheel 3 and fixed to the positioning holes 12 in the support member 1. A first central hole 31 is defined through the fixed wheel 3 and a belt groove 33 is defined in an outer periphery of the fixed wheel 3.

Two rotatable wheels 4, 5 each have a through hole 41/51 defined in a center thereof and a first groove 42/52 defined in an outer periphery of each of the rotatable wheels 4, 5. A first extension portion 43/53 extends from a side of each of the rotatable wheels 4, 5 and a second groove 431/531 is defined in each of the first extension portions 43, 53.

A weight wheel 9 has a second central hole 91 and a second extension portion 92 extends from a side of the weight wheel 9. A third groove 921 is defined in the second extension portion 92. The shaft 2 rotatably extends through the first central hole 31 of the fixed wheel 3 and the second central hole 91 of the weight wheel 9. The fixed wheel 3 and the weight wheel 9 shares a common shaft 2. Two cranks "A", "A'" are respectively connected to two ends of two ends of the shaft 2 and each crank "A"/"A'" is connected with a pedal. The two extensions 211 of the link 21 rotatably extend through the through holes 41, 51 of the two rotatable wheels 4, 5.

A first belt 6 is engaged with the belt groove 33 of the fixed wheel 3 and the second groove 431 of the first extension portion 43 on the rotatable wheel 4. A second belt 7 is engaged with the first groove 42 of the rotatable wheel 4 and second groove 531 of the first extension portion 53 on the rotatable wheel 5. A third belt 8 is engaged with the first groove 52 in the rotatable wheel 5 and the third groove 921 of the second extension portion 92 on the weight wheel 9.

Figure 5:
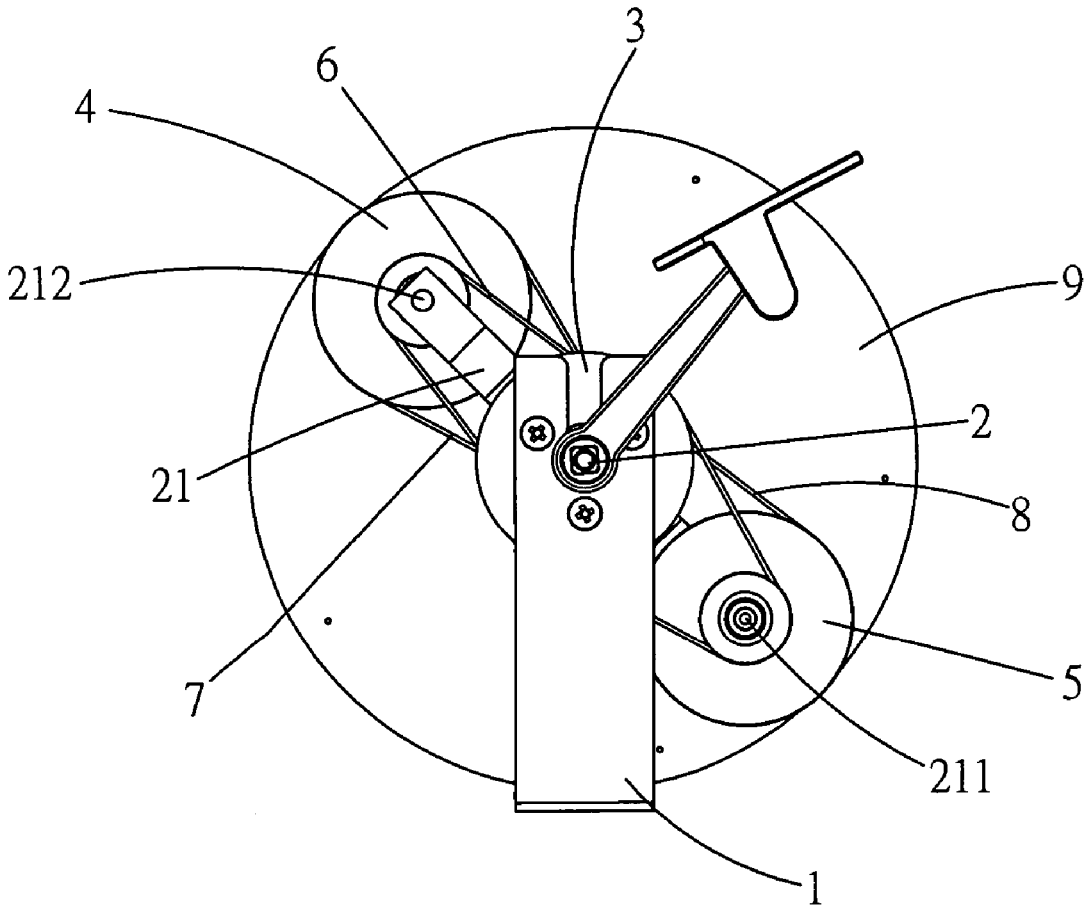
FIG. 5 shows when the cranks are rotated, the rotatable wheel are moved relative to the shaft.
Figure 6:
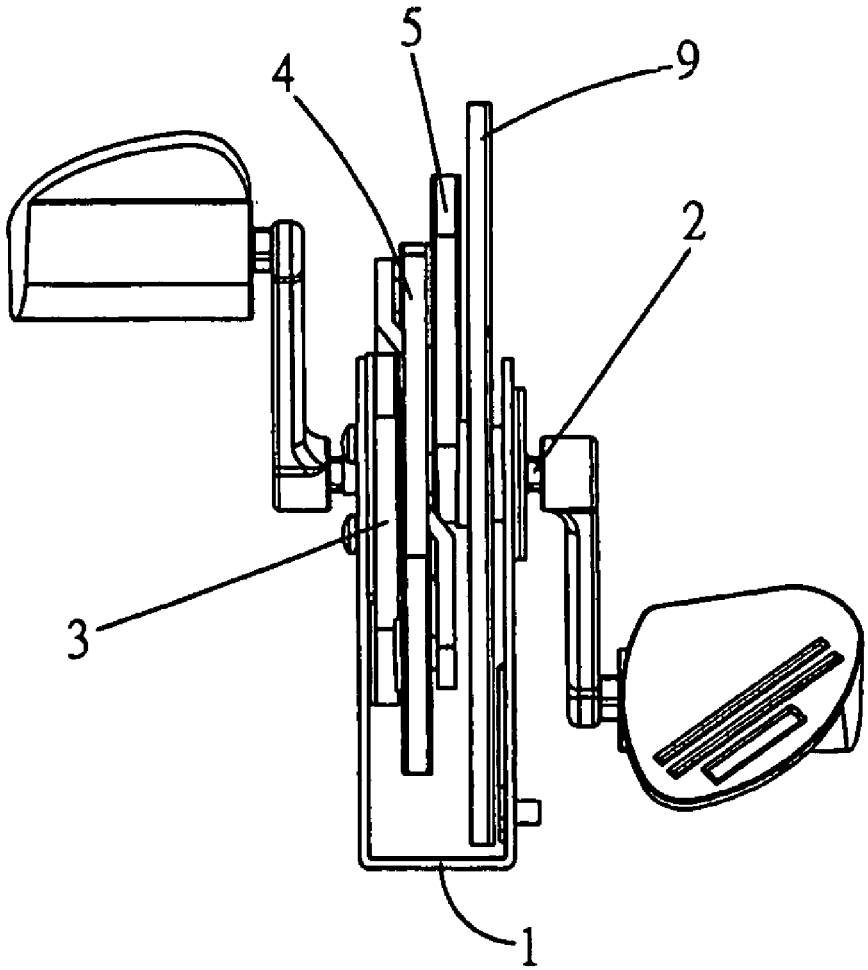
FIG. 6 is an end view to show the drive system of the present invention.
Figure 7:
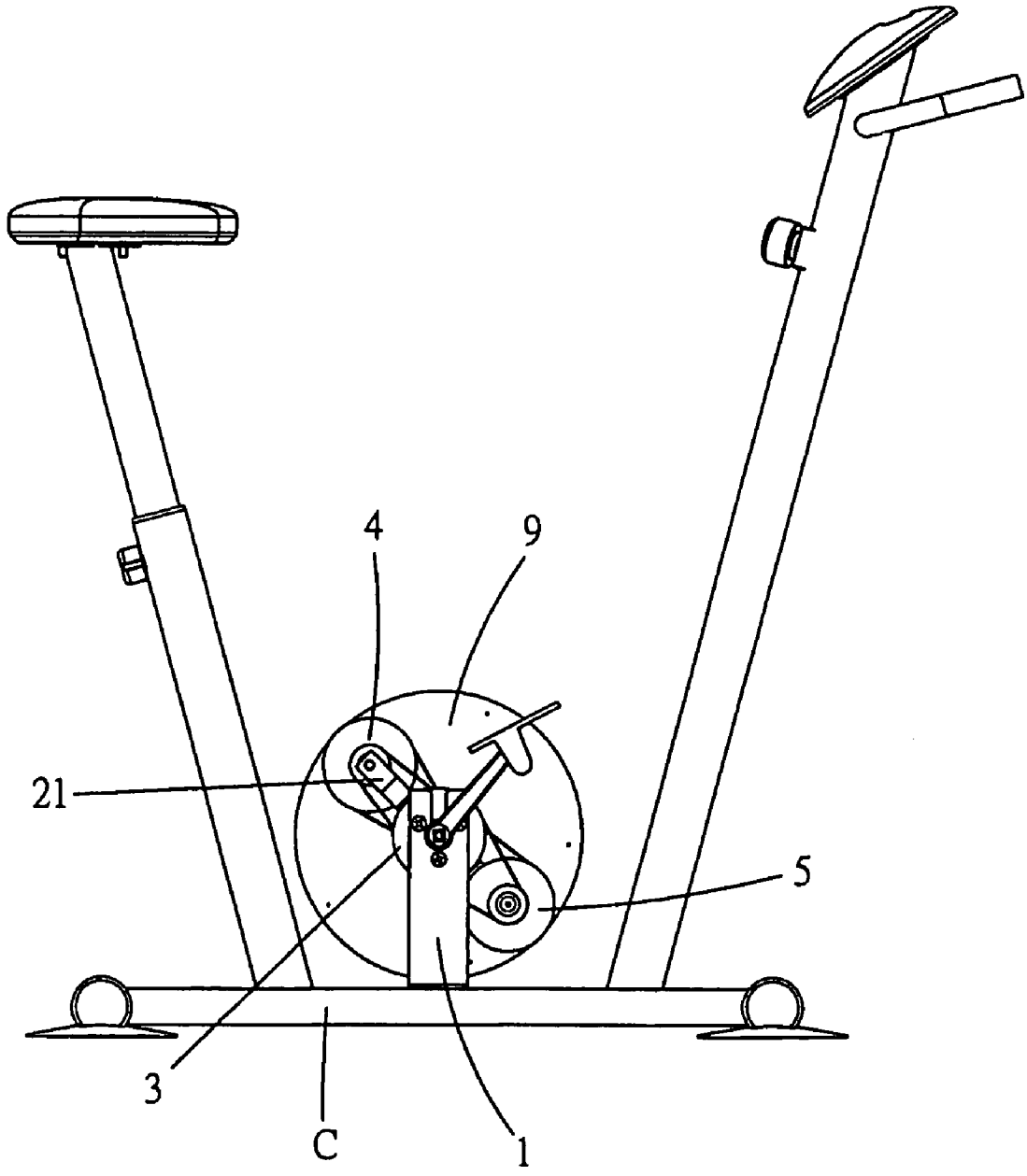
FIG. 7 shows that the drive system is used on a magnetic resistance exerciser.
Figure 8:
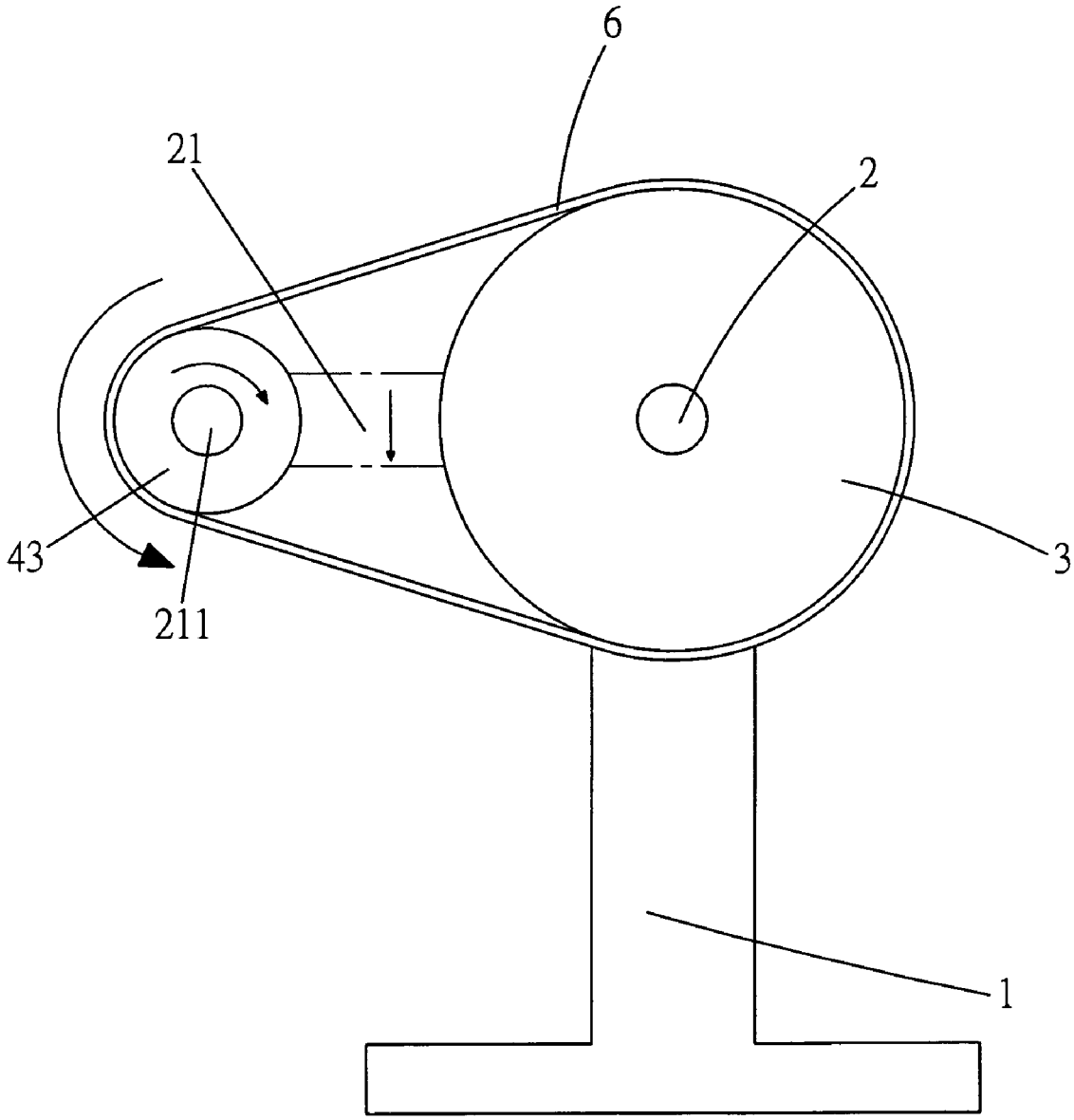
FIG. 8 shows the rotational directions of the fixed wheel and the rotatable wheel.

As shown in FIG. 7, the drive system is installed to a magnetic resistance exerciser "C" and when the user treads the cranks "A", "A'", the shaft 2 is rotated and the link 21 is rotated with the rotation of the shaft 2. The rotatable wheels 4 and 5 are rotated about the shaft 2 by the rotation of the link 21. In the meanwhile, the rotatable wheels 4, 5 are respectively rotated about the two respective extensions 211, 212 of the link 21. Referring to FIGS. 5, 6 and 8, the rotatable wheel 4 is rotated about the extension 212 at a center thereof by the first belt 6 and the rotation of the rotatable wheel 4 drives the other rotatable wheel 5 by the second belt 7. The rotation of the rotatable wheel 5 drives the weight wheel 9 by the third belt 8. Therefore, the rotational speed of the weight wheel 9 is increased while the size of the fixed wheel 3, the rotatable wheels 4, 5 and the weight wheel 9 are remained the same.

It is noted that the number of the rotatable wheels 4, 5 can be added when needed and the number of the shaft 2 may also be added to connect with the rotatable wheels 4, 5. The link 21 can be made as a four-link device or multiple-link device to connect the rotatable wheels 4, 5 when needed.

While we have shown and described the embodiment in accordance with the present invention, it should be clear to those skilled in the art that further embodiments may be made without departing from the scope of the present invention.

What is claimed is:

1. A driving system for a magnetic resistance exerciser, the driving system comprising:

a support member having a through hole defined therethrough and a plurality of positioning holes defined beside the through hole;

a link having a shaft extending perpendicularly from a mediate portion thereof and an extension perpendicularly extending from each of two ends of the link;

a fixed wheel fixedly connected to the support member and having a first central hole defined therethrough, a belt groove defined in an outer periphery of the fixed wheel;

first and second rotatable wheels, each having a through hole defined in a center thereof, a first groove defined in an outer periphery thereof, an extension portion extending from a side of each rotatable wheel and a second groove defined in the extension portion, and a weight wheel having a second central hole and an extension portion extending from a side of the weight wheel, a third groove defined in the extension portion of the weight wheel, the shaft rotatably extending through the first central hole and the second central hole, a crank connected to each end of the shaft, one of the extensions of the link rotatably extending through the through hole of the first rotatable wheel and the other extension of the link rotatably extending through the through hole of the second rotatable wheel, a first belt engaged with the belt groove of the fixed wheel and the second groove of the extension portion of the first rotatable wheel, a second belt engaged with the first groove of the first rotatable wheel and the second groove of the extension portion of the second rotatable wheel, and a third belt engaged with the first groove of the second rotatable wheel and the third groove of the extension portion of the weight wheel.

2. The system as claimed in claim 1, wherein when the shaft is rotated by operating the cranks, the link is rotated with the rotation of the shaft and the rotatable wheels are rotated about the shaft by the rotation of the link, the rotatable wheels are also rotated about the link extensions extending through the through holes of the rotatable wheels by the first and second belts and the weight wheel is rotated by the third belt which connects one of the rotatable wheels to the extension portion of the weight wheel.

* * * * *